US011333326B1

(12) United States Patent
Kando et al.

(10) Patent No.: US 11,333,326 B1
(45) Date of Patent: May 17, 2022

(54) LIGHT EMITTING DEVICE

(71) Applicant: FUJIFILM Business Innovation Corp., Tokyo (JP)

(72) Inventors: Yuji Kando, Kanagawa (JP); Yosuke Kasuya, Kanagawa (JP); Shuichi Nishide, Kanagawa (JP); Seiichi Takayama, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/325,531

(22) Filed: May 20, 2021

(30) Foreign Application Priority Data

Oct. 27, 2020 (JP) ..... JP2020-179373

(51) Int. Cl.
*F21V 15/04* (2006.01)
*G03G 15/04* (2006.01)

(52) U.S. Cl.
CPC ..... *F21V 15/04* (2013.01); *G03G 15/04036* (2013.01)

(58) Field of Classification Search
CPC ..... F21V 15/04; G03G 15/04036
See application file for complete search history.

(56) References Cited

U.S. PATENT DOCUMENTS 10,496,003 B2 12/2019 No et al.
2019/0072873 A1* 3/2019 No ..... G03G 15/0105

FOREIGN PATENT DOCUMENTS

JP 2019-49686 A 3/2019

* cited by examiner

*Primary Examiner* — Thomas M Sember
(74) *Attorney, Agent, or Firm* — Sughrue Mion, PLLC

(57) ABSTRACT

A light emitting device includes a light emitting unit including plural light emitting elements arranged in one direction, the light emitting unit being positioned at a predetermined position at both ends in the one direction, the light emitting elements emitting light in a same direction; a dynamic vibration absorber including a weight positioned at a center of the light emitting unit in the one direction and an elastic portion that supports the weight such that the weight is capable of vibrating, the dynamic vibration absorber being attached to the light emitting unit to absorb vibration of the light emitting unit; and an attaching member including a portion inserted in a groove formed in the elastic portion of the dynamic vibration absorber, the portion being used to attach the dynamic vibration absorber to the light emitting unit.

9 Claims, 9 Drawing Sheets

| M1 (mm) | M2 (mm) | s (mm) | t (mm) | | L (mm) | $f_{ave}$ (Hz) |
|---|---|---|---|---|---|---|
| 25 | 15.5 | 0.3 | 1 | FREE LENGTH | 58 | 133.5 |
| 25 | 14 | 0.3 | 1 | FREE LENGTH | 55 | 151.3 |
| 25 | 12.5 | 0.3 | 1 | FREE LENGTH | 52 | 169 |

LIGHT EMITTING DEVICE

CROSS-REFERENCE TO RELATED APPLICATIONS

This application is based on and claims priority under 35 USC 119 from Japanese Patent Application No. 2020-179373 filed Oct. 27, 2020.

BACKGROUND

(i) Technical Field

The present disclosure relates to a light emitting device.

(ii) Related Art

Japanese Unexamined Patent Application Publication No. 2019-49686, for example, discloses an exposure device including an exposure unit, a weight, and an elastic portion. The exposure unit includes plural light emitting elements arranged in an axial direction of an image carrier that rotates, and is positioned with respect to the image carrier at both ends thereof in the axial direction. The exposure unit emits light toward the image carrier to expose the image carrier to light. The weight is disposed to face the exposure unit and has a predetermined mass. The elastic portion, which is elastic, is disposed between the exposure unit and the weight and supports the weight in such a manner that the weight can be vibrated.

SUMMARY

The elastic portion may be attached to a light emitting unit on a manufacturing line by using, for example, an adhesive. In such a case, variations in attachment strength may cause separation between bonded portions that leads to removal of the elastic portion after shipment. To reduce variations in the attachment strength of the adhesive, the workload of a worker needs to be increased, and it is therefore difficult to improve the work efficiency.

Aspects of non-limiting embodiments of the present disclosure relate to an improvement of work efficiency compared to when an adhesive is used for the attachment.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a light emitting device including a light emitting unit including a plurality of light emitting elements arranged in one direction, the light emitting unit being positioned at a predetermined position at both ends in the one direction, the light emitting elements emitting light in a same direction; a dynamic vibration absorber including a weight positioned at a center of the light emitting unit in the one direction and an elastic portion that supports the weight such that the weight is capable of vibrating, the dynamic vibration absorber being attached to the light emitting unit to absorb vibration of the light emitting unit; and an attaching member including a portion inserted in a groove formed in the elastic portion of the dynamic vibration absorber, the portion being used to attach the dynamic vibration absorber to the light emitting unit.

BRIEF DESCRIPTION OF THE DRAWINGS

An exemplary embodiment of the present disclosure will be described in detail based on the following figures, wherein:

FIGS. 5A and 5B illustrate an attachment structure for attaching the dynamic vibration absorber to an LPH, wherein FIG. 5A is a projection view illustrating a state before attachment and FIG. 5B is a perspective view illustrating a state after attachment;

FIGS. 6A to 6C illustrate the attachment structure for attaching the dynamic vibration absorber to the LPH, wherein FIGS. 6A and 6C are perspective views of attachment members and FIG. 6B is a perspective view illustrating the engagement between an attachment member and the dynamic vibration absorber;

FIGS. 8A and 8B illustrate the relationship between the distance between attachment members and the natural frequency, wherein FIG. 8A is a diagram illustrating the dimensions of the dynamic vibration absorber used to calculate the natural frequency, and FIG. 8B is a table showing the calculation results.

DETAILED DESCRIPTION

An exemplary embodiment of the present disclosure will now be described in detail with reference to the accompanying drawings.

Figure 1:
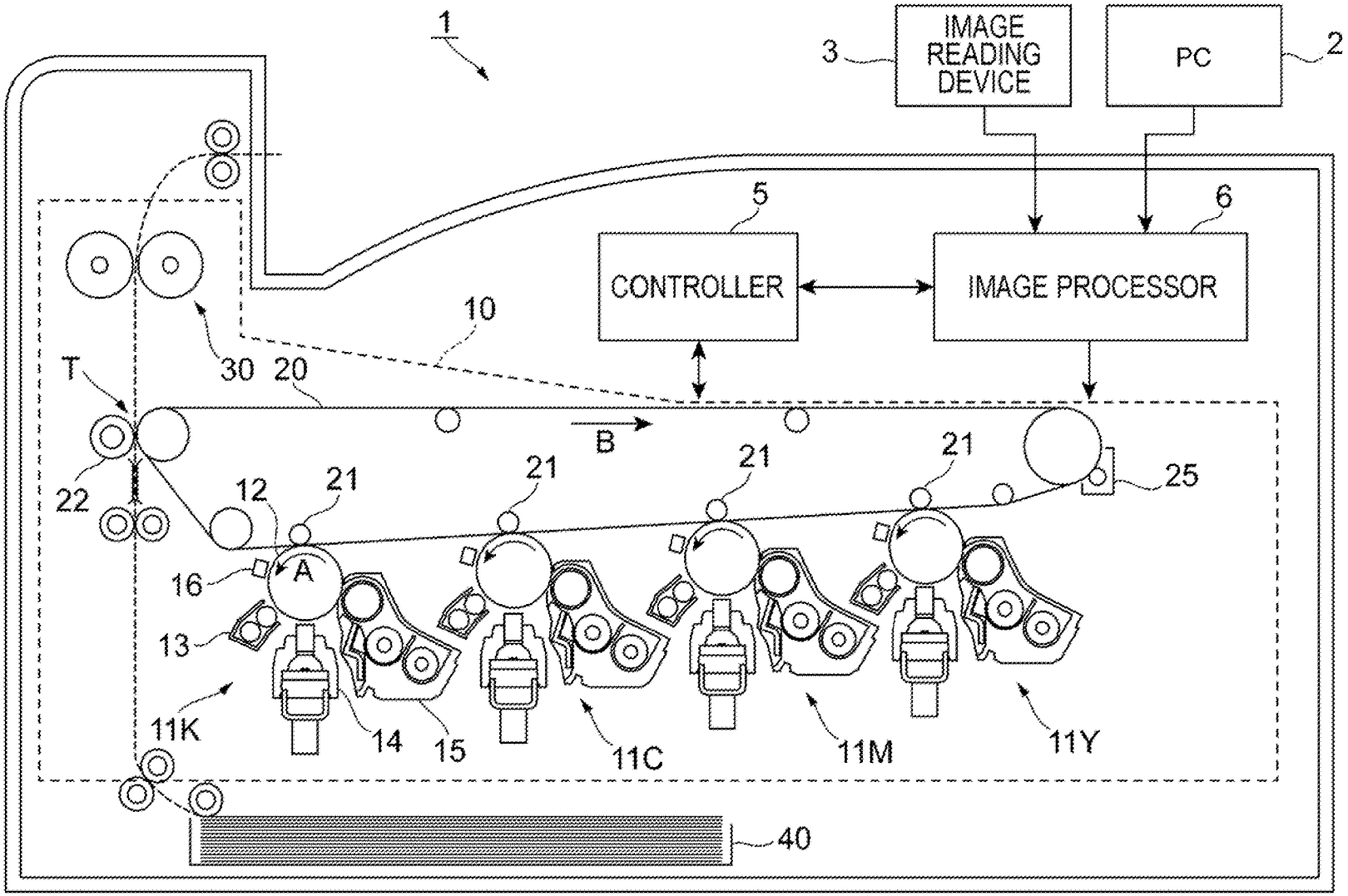
FIG. 1 illustrates the overall structure of an image forming apparatus according to an exemplary embodiment.

FIG. 1 illustrates the overall structure of an image forming apparatus 1 according to the present exemplary embodiment.

The image forming apparatus 1 is an apparatus that is generally referred to as a tandem image forming apparatus. The image forming apparatus 1 includes an image forming section 10 that forms an image based on image data of different colors; a controller 5 that controls the overall operation of the image forming apparatus 1; and a paper sheet holder 40 that holds paper sheets supplied to the image forming apparatus 1. The image forming apparatus 1 also includes an image processor 6 that performs a predetermined image process on the image data received from, for example, a personal computer (PC) 2 or an image reading device 3.

The image forming section 10 includes four image forming units 11Y, 11M, 11C, and 11K (also referred to generically as "image forming units 11") that are arranged next to each other with certain intervals therebetween. Each image forming unit 11 includes a photoconductor drum 12, which is an example of an image carrier on which an electrostatic latent image is formed and that carries a toner image; a charging device 13 that charges the surface of the photoconductor drum 12 to a predetermined potential; an exposure device 14 that exposes the photoconductor drum 12 charged by the charging device 13 to light based on the image data of a corresponding color; a developing device 15 that develops the electrostatic latent image formed on the photoconductor drum 12; and a drum cleaner 16 that cleans the surface of the photoconductor drum 12 after a transferring process.

The image forming units 11 have similar structures except for the type of the toner stored in the developing devices 15 thereof, and individually form yellow (Y), magenta (M), cyan (C), and black (K) toner images.

The image forming section 10 also includes an intermediate transfer belt 20, first transfer rollers 21, a second transfer roller 22, a belt cleaner 25, and a fixing device 30. The toner images of respective colors formed on the photoconductor drums 12 of the image forming units 11 are transferred to the intermediate transfer belt 20 in a superposed manner. The first transfer rollers 21 successively transfer the toner images of respective colors formed by the image forming units 11 to the intermediate transfer belt 20 in a first transfer process. The second transfer roller 22 simultaneously transfers the toner images of the respective colors transferred to the intermediate transfer belt 20 in a superposed manner to a paper sheet, which is a recording material, in a second transfer process. The belt cleaner 25 cleans the surface of the intermediate transfer belt 20 after the second transfer process. The fixing device 30 fixes the toner images of respective colors transferred in the second transfer process to the paper sheet P.

The image forming section 10 of the image forming apparatus 1 performs an image forming operation based on various control signals supplied from the controller 5. More specifically, the image data input by the PC 2 or the image reading device 3 is subjected to the image process performed by the image processor 6 and supplied to each of the image forming units 11 under the control of the controller 5. Each image forming unit 11 operates so that the photoconductor drum 12 is charged by the charging device 13 and exposed to light by the exposure device 14, and that the electrostatic latent image is developed by the developing device 15. Thus, toner images of respective colors are formed on the surfaces of the photoconductor drums 12.

The toner images of the respective colors formed on the photoconductor drums 12 are successively transferred to the intermediate transfer belt 20 by the first transfer rollers 21.

Thus, a combined toner image is formed on the intermediate transfer belt 20, and is transported to a second transfer portion T, which is a region in which the second transfer roller 22 is disposed, as the intermediate transfer belt 20 moves. When the combined toner image is transported to the second transfer portion T, a paper sheet is supplied from the paper sheet holder 40 to the second transfer portion T at a time corresponding to the time at which the combined toner image reaches the second transfer portion T. Then, the combined toner image is electrostatically transferred to the transported paper sheet by a transfer electric field formed by the second transfer roller 22 at the second transfer portion T.

After that, the paper sheet to which the combined toner image has been transferred is transported to the fixing device 30, and is subjected to a fixing process in which heat and pressure are applied so that the toner image is fixed to the paper sheet. Then, the paper sheet having the toner image fixed thereto is transported to a paper-sheet stacking portion, which is included in an output unit of the image forming apparatus 1.

The toner that remains on the intermediate transfer belt 20 after the second transfer process is removed from the surface of the intermediate transfer belt 20 by the belt cleaner 25 after the second transfer process. The image forming apparatus 1 repeats the image forming cycle the same number of times as the number of sheets on which an image is to be printed.

The structure of each exposure device 14 according to the present exemplary embodiment will now be described. The exposure device 14 is an example of a light emitting device.

Figure 2A:
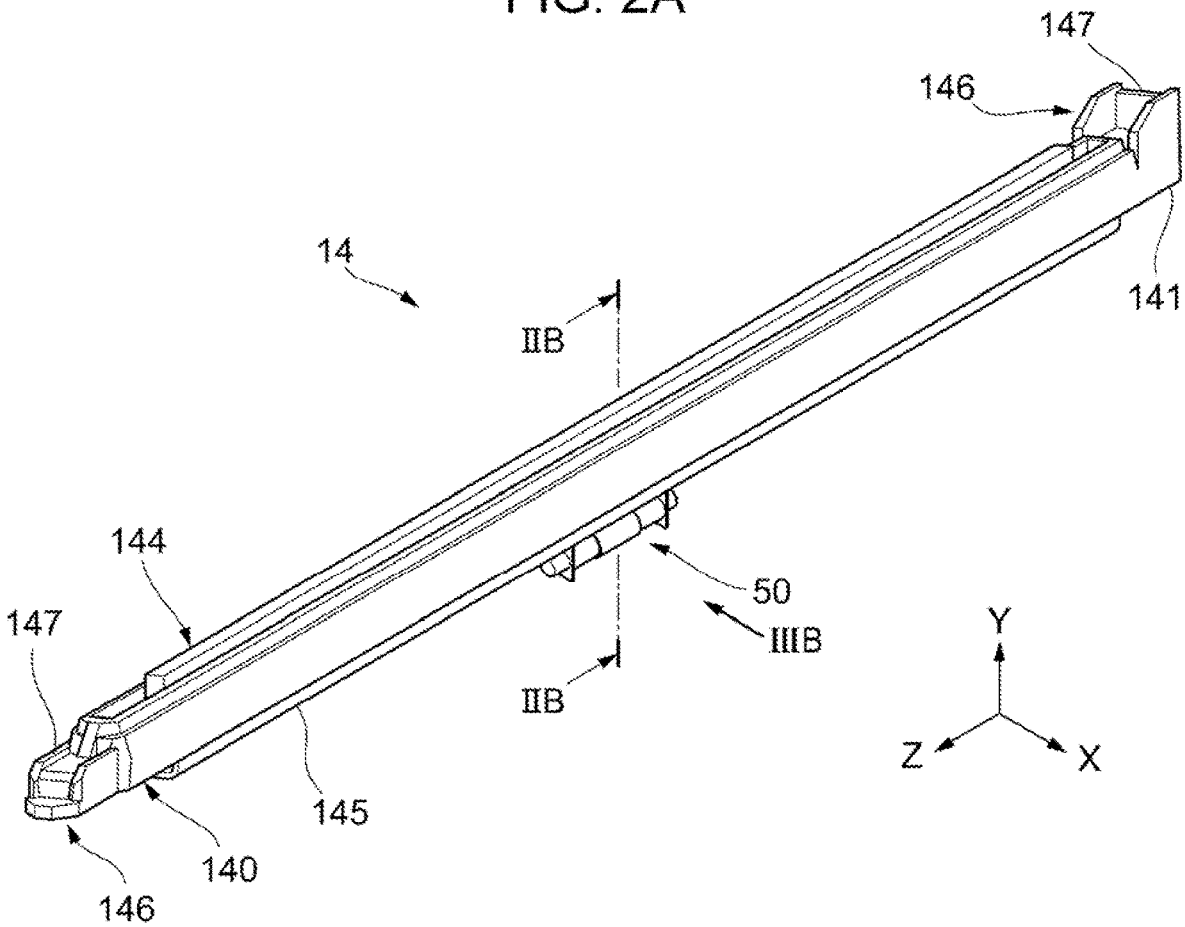
FIG. 2A is a perspective view of an exposure device according to the exemplary embodiment.
Figure 2B:
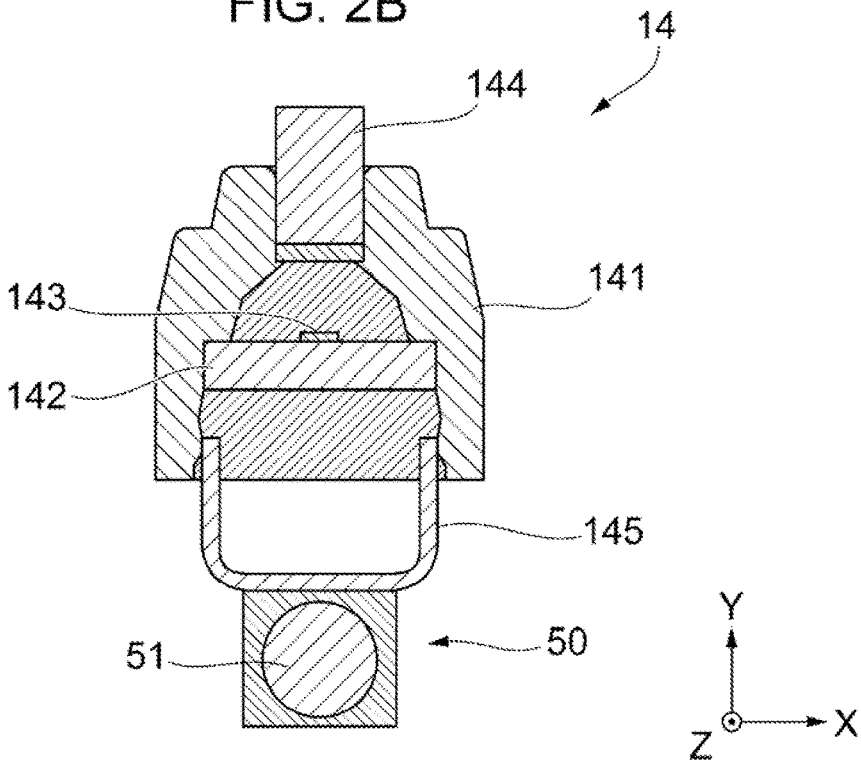
FIG. 2B is a sectional view of the exposure device taken along line IIB-IIB in FIG. 2A.
Figure 3A:
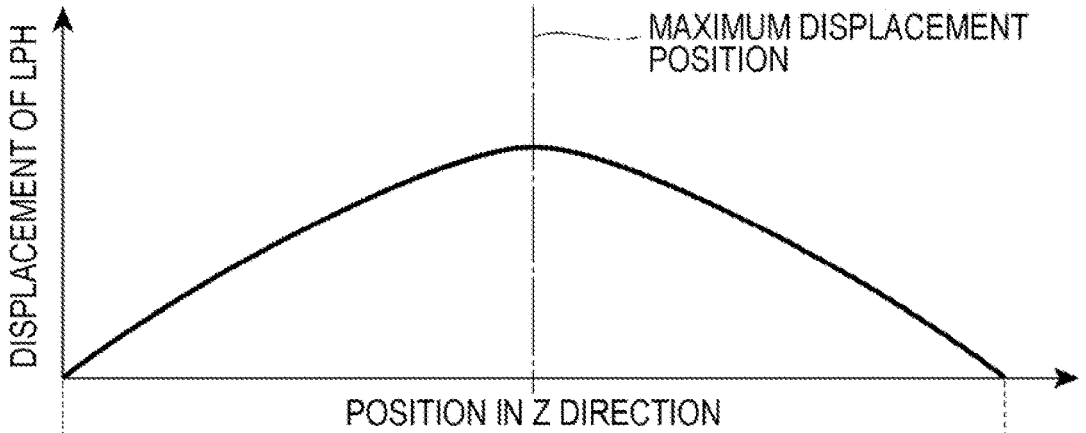
FIG. 3A is a graph showing the relationship between the position on the exposure device according to the exemplary embodiment in the Z direction and the displacement of the exposure device when the exposure device vibrates.
Figure 3B:
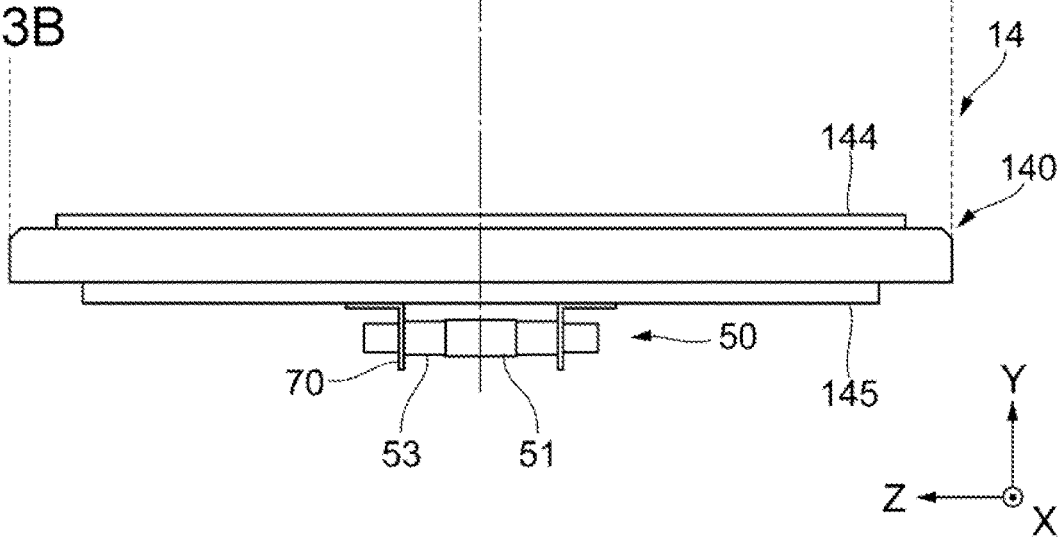
FIG. 3B illustrates the exposure device viewed in the direction of arrow IIIB in FIG. 2A.

FIGS. 2A, 2B, 3A, and 3B illustrate the exposure device 14 according to the present exemplary embodiment. FIG. 2A is a perspective view of the exposure device 14, and FIG. 2B is a sectional view of the exposure device 14 taken along line IIB-IIB in FIG. 2A. FIG. 3A is a graph showing the relationship between the position on the exposure device 14 in the Z direction, which will be described below, and the displacement of the exposure device 14 when the exposure device 14 vibrates. FIG. 3B illustrates the exposure device 14 viewed in the direction of arrow IIIB in FIG. 2A. FIG. 3B illustrates the position of a dynamic vibration absorber 50, which will be described below, on the exposure device 14.

Referring to FIG. 1, the image forming apparatus 1 is structured such that each exposure device 14 is disposed vertically below the corresponding photoconductor drum 12 and exposes the photoconductor drum 12 with light from vertically below. As illustrated in FIGS. 2A, 2B, and 3B, the exposure device 14 includes a light emitting diode (LED) print head (LPH) 140 and the dynamic vibration absorber 50, which will be described below. The dynamic vibration absorber 50 reduces vibration of the LPH 140.

The LPH 140 includes a housing 141; an LED array 143 having plural light emitting elements; an LED circuit board 142 on which components including the LED array 143 and a signal-generating circuit (not illustrated) that drive the LED array 143 are mounted; a rod lens array 144 that focuses light emitted from the LED array 143 on the surface of the photoconductor drum 12; and a frame 145 that reinforces the housing 141 and to which the dynamic vibration absorber 50 is attached. The LPH 140 includes first positioning portions 146 and second positioning portions 147 at both ends thereof in the axial direction of the photoconductor drum 12. The first positioning portions 146 position the LPH 140 with respect to the photoconductor drum 12 in the X direction. The second positioning portions 147 position the LPH 140 with respect to the photoconductor drum 12 in the Y direction. The LED array 143 is an example of light emitting elements, and the LPH 140 is an example of a light emitting unit.

In the following description, the optical axis direction of the rod lens array 144 included in the LPH 140 illustrated in FIGS. 2A, 2B, and 3B (direction in which light is emitted by the light emitting elements of the LED array 143) may be referred to as the Y direction. In addition, the main scanning direction, that is, the axial direction of the photoconductor drum 12 (see FIG. 1) may be referred to as the Z direction, one direction, or longitudinal direction. Also, the sub-scanning direction, that is, the direction orthogonal to both the Y direction and the Z direction, may be referred to as the X direction.

The housing 141 is made of, for example, a resin material, such as an ABS resin, and supports the LED circuit board 142 and the rod lens array 144.

The frame 145 is made of, for example, a metal material, such as steel or SUS, and is attached to the housing 141 at a side opposite to the side at which the rod lens array 144 is disposed. The dynamic vibration absorber 50 is attached to the frame 145 by attachment members 70 described below.

The rod lens array 144 is disposed to extend in the Z direction, which is the axial direction of the photoconductor drum 12, and has a width in the X direction, which is the direction in which the photoconductor drum 12 moves. The rod lens array 144 includes, for example, plural gradient index lenses that form erect equal-magnification real images and that are arranged in the axial direction of the photoconductor drum 12. The rod lens array 144 focuses light emitted from the LED array 143 on the surface of the photoconductor drum 12.

The LED array 143 is mounted on the LED circuit board 142. The LED array 143 includes plural LED chips which each include a light emitting element (LED) and that are arranged in the Z direction. Thus, the light emitting elements are arranged in the Z direction on the LED circuit board 142. The light emitting elements are arranged so that each light emitting element emits light toward the photoconductor drum 12 (toward the rod lens array 144) in the Y direction. The LED chips of the LED array 143 according to the present exemplary embodiment are arranged in a staggered pattern so that the light emitting elements overlap in the Z direction at the boundaries between adjacent ones of the LED chips.

When the exposure device 14 is installed in the image forming apparatus 1, the first positioning portions 146 and the second positioning portions 147 are pressed against an accommodating member (not illustrated) that accommodates and supports the photoconductor drum 12 in the image forming apparatus 1. More specifically, the first positioning portions 146 are pressed against the accommodating member of the photoconductor drum 12 in the X direction, and the second positioning portions 147 are pressed against the accommodating member of the photoconductor drum 12 in the Y direction.

Thus, the LPH 140 is positioned with respect to the photoconductor drum 12 in both the X direction and the Y direction at both ends thereof in the Z direction. The LPH 140 is positioned so that the distance between the rod lens array 144 of the LPH 140 and the photoconductor drum 12 is equal to the focal length of the rod lens array 144.

In the present exemplary embodiment, a central portion of the LPH 140 in the Z direction, that is, a portion of the LPH 140 in a region between the first positioning portions 146 and the second positioning portions 147 at both ends in the Z direction, is not in contact with the photoconductor drum 12 and is spaced from the photoconductor drum 12.

In the present exemplary embodiment, the LPH 140 has an elongated shape that extends in the Z direction, and is positioned with respect to the photoconductor drum 12 at both ends thereof in the Z direction. The LPH 140 having such a structure may be bent and vibrate when vibration is applied thereto from the outside of the exposure device 14. More specifically, the central portion of the LPH 140 in the Z direction may vibrate in the Y direction or X direction in FIG. 2A.

When, for example, the LPH 140 vibrates in the Y direction, the distance between the rod lens array 144 and the surface of the photoconductor drum 12 varies. Accordingly, the size of the exposure point of the light emitted by the LPH 140 varies. When the LPH 140 vibrates in the X direction, the exposure point is shifted in the X direction and causes distortion of an image. As a result, there is a risk that an image having defects, such as streaks or uneven color, will be formed. In particular, vibration of the LPH 140 in the X direction tends to have a large influence on the image.

As described above, the LPH 140 according to the present exemplary embodiment is positioned with respect to the photoconductor drum 12 at both ends thereof in the Z direction, and the central portion thereof in the Z direction is spaced from the photoconductor drum 12. Therefore, as illustrated in FIG. 3A, the amplitude of the vibration of the LPH 140 increases toward the center of the LPH 140 in the Z direction.

When the frequency of the vibration applied to the LPH 140 from the outside is close to the natural frequency of the LPH 140, the LPH 140 easily resonates with the vibration applied from the outside. In this case, the vibration of the LPH 140 increases, and image defects easily occur.

To reduce the vibration of the LPH 140, according to the present exemplary embodiment, the LPH 140 is provided with a dynamic vibration absorber including a weight and elastic portions and having a natural frequency close to that of the LPH 140. The natural frequency of the dynamic vibration absorber is determined by the spring constant of the elastic portions and the mass of the weight.

Figure 4:
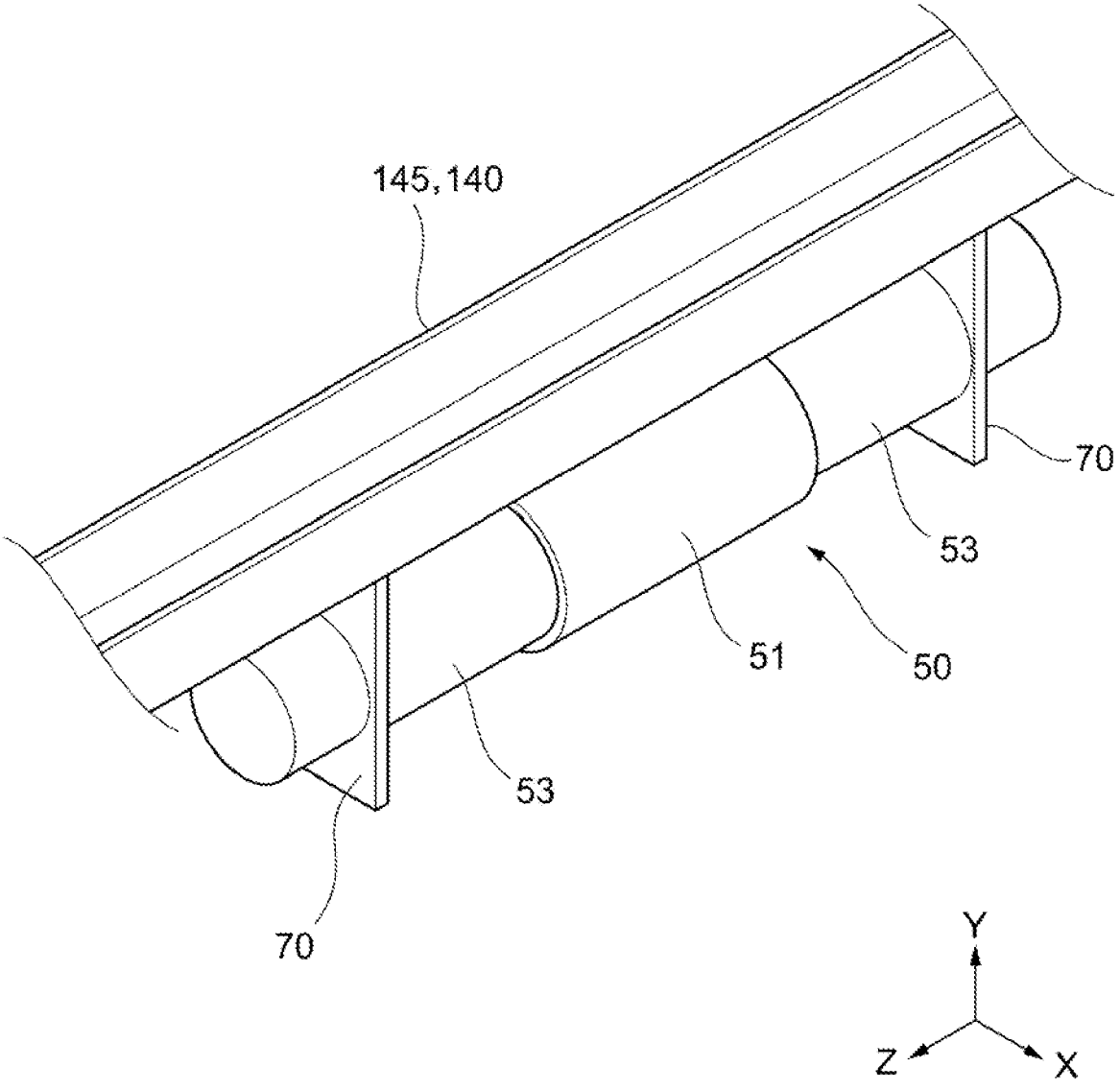
FIG. 4 illustrates the structure of a dynamic vibration absorber according to the exemplary embodiment.

FIG. 4 is a perspective view of the dynamic vibration absorber 50 according to the present exemplary embodiment, illustrating the structure of the dynamic vibration absorber 50. In FIG. 4, components of the LPH 140 other than the frame 145 are not illustrated. The structure of the dynamic vibration absorber 50 will now be described in detail with reference also to FIGS. 2A, 2B, 3A, and 3B described above.

As illustrated in FIG. 4, the dynamic vibration absorber 50 includes a weight 51 that is disposed to face the LPH 140 and that has a predetermined mass, and two elastic portions 53 that are made of a viscoelastic material and that support the weight 51. The weight 51 and the elastic portions 53 of the dynamic vibration absorber 50 are arranged in the Z direction. More specifically, the elastic portions 53 are disposed on both ends of the weight 51 in the Z direction.

When vibration is applied to the LPH 140 from the outside, the weight 51 vibrates with the elastic portions 53 disposed between the weight 51 and the LPH 140. The weight 51 is positioned at the center of the LED array 143 in the Z direction, which is the one direction.

The weight 51 according to the present exemplary embodiment has a cylindrical shape having an axis extending in the Z direction. Accordingly, as illustrated in FIG. 2B, the weight 51 has a circular cross section along a plane perpendicular to the Z direction (XY plane).

The elastic portions 53 are made of a viscoelastic material that is both viscous and elastic, and support the weight 51 such that the weight 51 is capable of vibrating with respect to the LPH 140.

Each elastic portion 53 has a cylindrical shape having an axis extending in the Z direction. Accordingly, each elastic portion 53 has a circular cross section along a plane perpendicular to the Z direction (XY plane).

The material of the weight 51 is not particularly limited, but a material having an appropriate mass (M1 described below) is selected. The material of the weight 51 may be a material having a density greater than that of the material of the elastic portions 53. For example, a metal material, such as steel or SUS, or a resin material may be used.

The material of the elastic portions 53 is not particularly limited, but a material having an appropriate spring constant (K described below) is selected. The material of the elastic portions 53 may be, for example, a porous material, such as sponge, a rubber material, or a resin material.

The elastic portions 53 of the dynamic vibration absorber 50 are connected to the attachment members 70 provided on a central portion of the frame 145 in the Z direction. Thus, the weight 51 and the elastic portions 53 of the dynamic vibration absorber 50 are arranged to be spaced from the frame 145.

The attachment members 70, which are examples of attaching members, are attached to the frame 145 of the LPH 140 and hold the dynamic vibration absorber 50 so that the dynamic vibration absorber 50 faces the LPH 140. The attachment members 70 are composed of members that are not elastically deformed when vibration is applied to the exposure device 14 from the outside. The attachment members 70 may be composed of, for example, steel plates made of steel of SUS. The attachment members 70 may be integrated with the frame 145.

In this example, the attachment members 70 are two plate-shaped members that are arranged in the Z direction with a gap therebetween and that extend upstream in the Y direction (vertically downward relative to the exposure device 14) from the frame 145.

As illustrated in FIGS. 3A and 3B, in the present exemplary embodiment, the dynamic vibration absorber 50 is disposed at a position where the displacement of the LPH 140 that vibrates is at a maximum (hereinafter referred to as a maximum displacement position). More specifically, the weight 51 of the dynamic vibration absorber 50 is disposed at the maximum displacement position.

When the dynamic vibration absorber 50 is disposed at the maximum displacement position as described above, the vibration of the LPH 140 may be more easily absorbed by the dynamic vibration absorber 50 than when the dynamic vibration absorber 50 is disposed at a position other than then maximum displacement position.

When M is the mass of the weight 51 and K is the spring constant of the elastic portions 53, the natural frequency f of the dynamic vibration absorber 50 may be determined by the following equation:

$$f = \frac{1}{2\pi}\sqrt{\frac{K}{M}}$$

The operation of the dynamic vibration absorber 50 will now be described.

As described above, in the present exemplary embodiment, the natural frequency f of the dynamic vibration absorber 50 is equal to a natural frequency fa of the LPH 140. When vibration is applied to the exposure device 14 from the outside, the weight 51 of the dynamic vibration absorber 50 vibrates instead of the LPH 140. In addition, the elastic portions 53 are repeatedly deformed due to the vibration of the weight 51, and the vibration is reduced due to the viscosity of the elastic portions 53. As a result, the vibration of the LPH 140 is absorbed by the dynamic vibration absorber 50, and is thereby reduced.

As described above, the dynamic vibration absorber 50 is attached to the frame 145 of the LPH 140 by the attachment members 70 such that the dynamic vibration absorber 50 is not in contact with, and is spaced from, the LPH 140. Accordingly, load placed on the LPH 140 is less than when, for example, an elastic member or the like is pressed against the LPH 140 to reduce the vibration of the LPH 140.

Figure 5A:
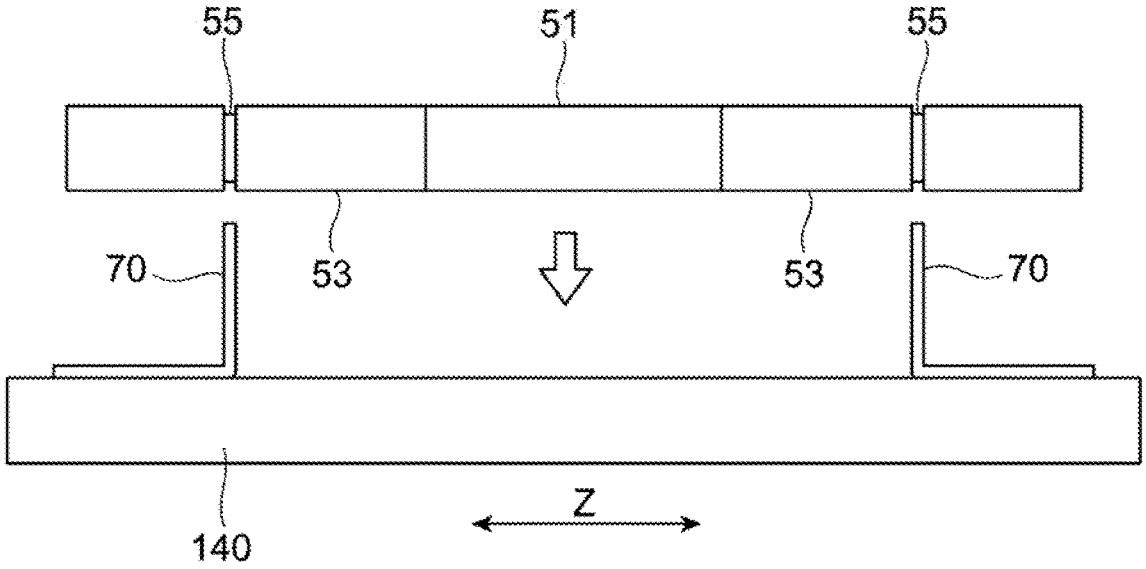
Figure 5B:
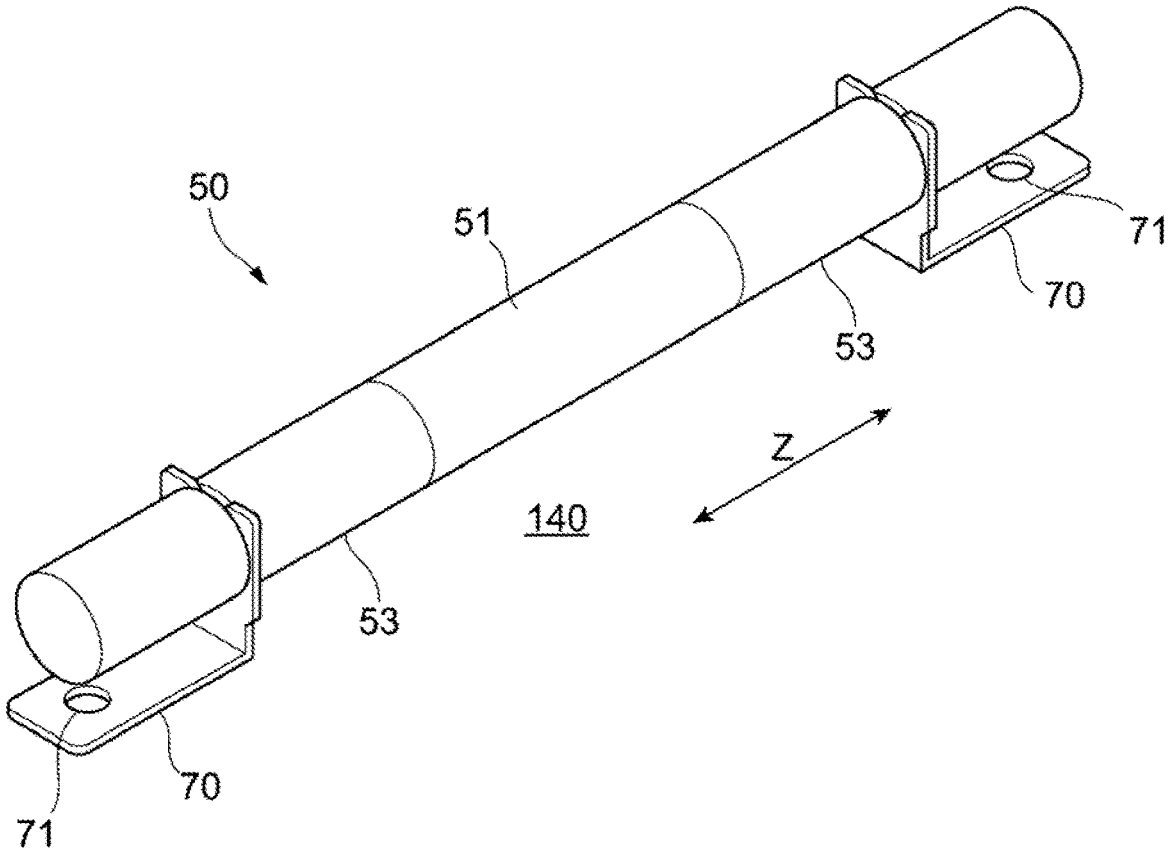
Figure 6A:
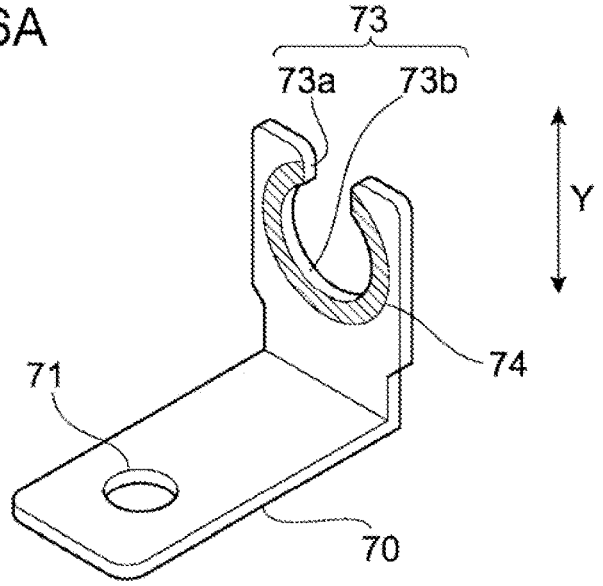
Figure 6B:
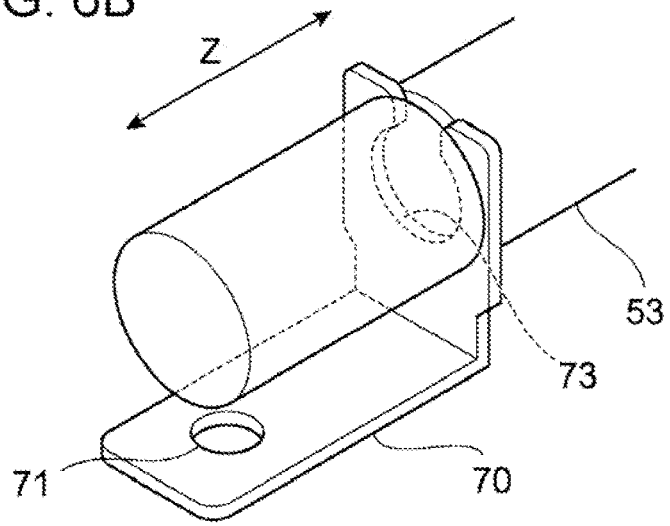
Figure 6C:
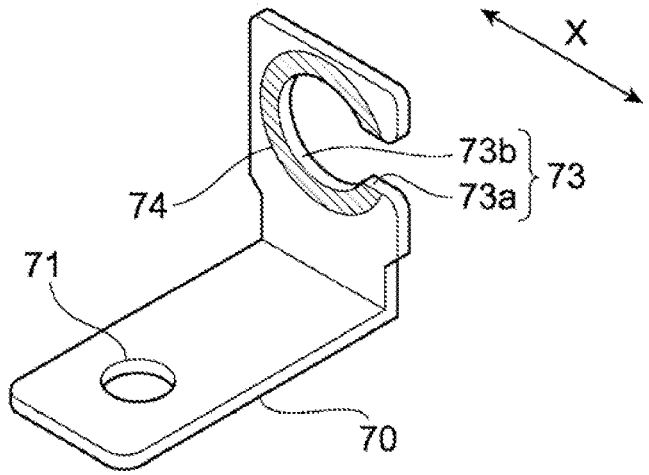

FIGS. 5A and 5B and FIGS. 6A to 6C illustrate the attachment structure for attaching the dynamic vibration absorber 50 to the LPH 140. FIG. 5A is a projection view illustrating a state before attachment, and FIG. 5B is a perspective view illustrating a state after attachment. FIGS. 6A and 6C are perspective views of attachment members 70, and FIG. 6B is a perspective view illustrating the engagement between an attachment member 70 and the dynamic vibration absorber 50. For the convenience of description, the positional relationship between the LPH 140 and the dynamic vibration absorber 50 illustrated in FIGS. 5A and 5B and FIGS. 6A to 6C is reversed from that in FIGS. 1A to 4. This also applies to FIGS. 7A to 7C and other figures.

As illustrated in FIG. 5A, the elastic portions 53 of the dynamic vibration absorber 50 have grooves 55 that extend in a circumferential direction. Two grooves 55 are arranged such that the weight 51 is disposed therebetween. The grooves 55 extend over the entire circumference.

The dynamic vibration absorber 50 is attached to the attachment members 70 in the direction shown by the arrow.

As illustrated in FIG. 5B, the attachment members 70 have portions 74 to be inserted into the grooves 55 in the dynamic vibration absorber 50. The portions 74 of the attachment members 70 are fitted to the grooves 55 so that the dynamic vibration absorber 50 is held at two points. Thus, the dynamic vibration absorber 50 is attached to the attachment members 70 by using the grooves 55.

As illustrated in FIG. 6A, each attachment member 70 is an L-shaped angular member. The attachment member 70 has an attachment hole 71 and a cut portion 73 for attaching the dynamic vibration absorber 50. The cut portion 73 is shaped to be engageable with the groove 55 in each elastic portion 53.

Each attachment member 70 may have plural attachment holes 71, and each attachment hole 71 may have an elliptical shape instead of a circular shape to enable position adjustment.

The cut portion 73 has an opening 73*a* formed by cutting an edge of the attachment member 70 and an arc shaped portion 73*b* formed behind the opening 73. The opening 73*a* and the arc shaped portion 73*b* are continuous to each other. Thus, the cut portion 73 has an open shape with a cut. The opening 73*a* of the cut portion 73 is an example of the cut.

The opening width of the opening 73*a* is less than the outer diameter of the groove 55 in each elastic portion 53, and the diameter of the arc shaped portion 73*b* corresponds to the outer diameter of the groove 55 in each elastic portion 53. Therefore, each elastic portion 53 may be compressed to be deformed so that the elastic portion 53 is able to pass through the opening 73*a*. After passing through the opening 73*a*, the elastic portion 53 returns to the state before the deformation or expands such that the amount of deformation is less than that when the elastic portion 53 passes through the opening 73*a*. Thus, as illustrated in FIG. 6B, the elastic portion 53 is in contact with and held by the peripheral edge of the arc shaped portion 73*b*.

The dynamic vibration absorber 50 may be held in a state such that the dynamic vibration absorber 50 does not easily fall off the attachment members 70 but is easily removable from the attachment members 70 by deforming each elastic portion 53 so as to enable the elastic portion 53 to pass through the opening 73*a*.

In the present exemplary embodiment, each attachment member 70 has the cut portion 73 formed at a side opposite to the side at which the dynamic vibration absorber 50 is disposed, and the dynamic vibration absorber 50 is attached to the attachment members 70 in the Y direction (see, for example, FIG. 4). However, the attachment members 70 are not limited to this. For example, the cut portion 73 of each attachment member 70 may instead be formed such that the dynamic vibration absorber 50 may be attached to the attachment member 70 in the X direction (see, for example, FIG. 4).

In addition, in the present exemplary embodiment, the two attachment members 70 include the cut portions 73 having the openings 73*a* formed so that the attachment members 70 are open in the same direction (for example, in the Y direction). However, the attachment members 70 are not limited to this, and may instead be formed to open in different directions. For example, the attachment members 70 illustrated in FIGS. 6A and 6C may be used. One of the two attachment members 70 opens in the Y direction (see FIG. 6A), and the other opens in the X direction (see FIG. 6C).

As another example, the two attachment members 70 may be formed so that the attachment members 70 are both open in the X direction (see FIG. 6C) but toward the opposite sides. The attachment members 70 attached to both ends of the dynamic vibration absorber 50 may have the same structure (see FIG. 6C).

Although each of the two attachment members 70 has the cut portion 73 in the present exemplary embodiment, the attachment members 70 are not limited to this. For example, one of the two attachment members 70 may have the cut portion 73 while the other has an attachment portion having a closed shape without the opening 73*a* instead of the cut portion 73.

In addition, according to the present exemplary embodiment, two attachment members 70 are provided as two components to facilitate development of, for example, a model in which the distance between the two attachment members 70 is adjustable in accordance with the natural frequency. However, a single component may instead be used.

Figure 7A:
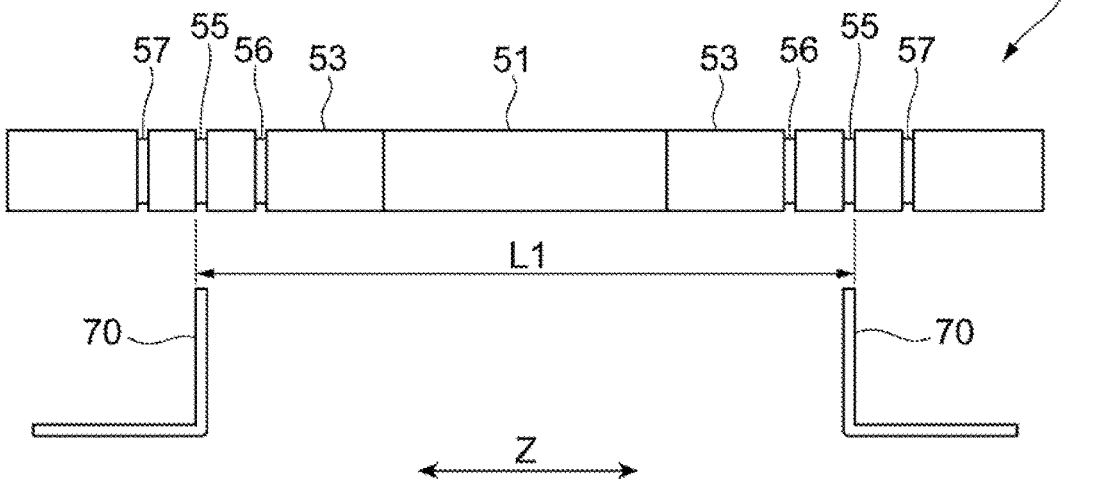
FIGS. 7A, 7B, and 7C are diagrams illustrating another attachment structure, wherein the attachment position differs between FIGS. 7A, 7B, and 7C.
Figure 7B:
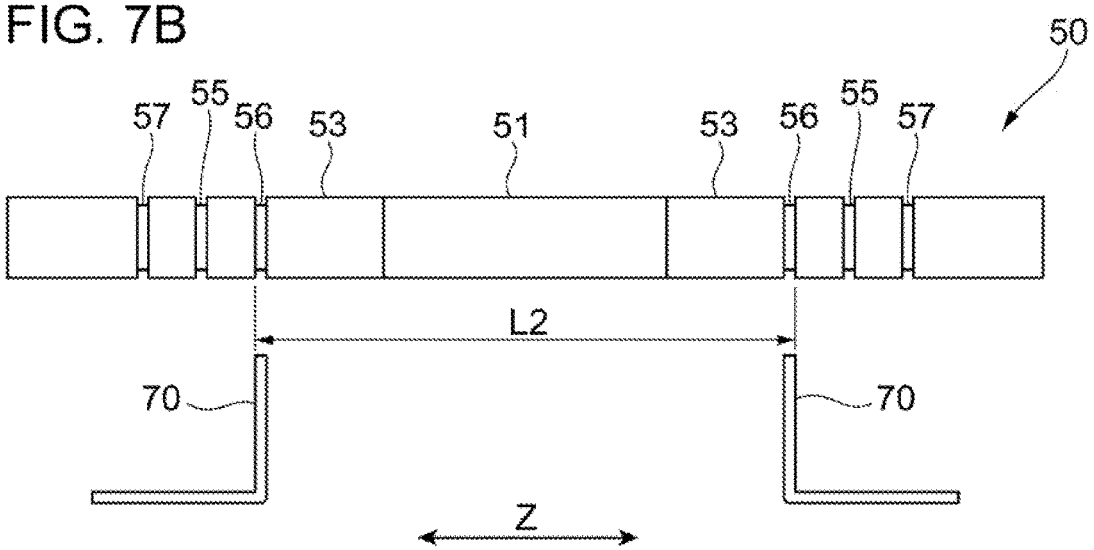
Figure 7C:
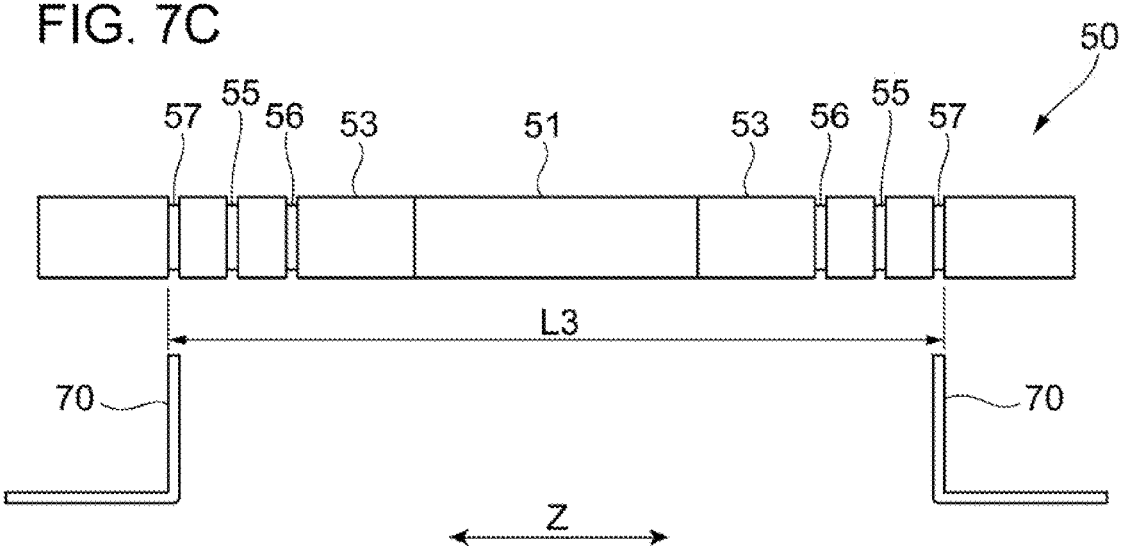

FIGS. 7A, 7B, and 7C are diagrams illustrating another attachment structure, wherein the attachment position differs between FIGS. 7A, 7B, and 7C.

In the attachment structure illustrated in FIGS. 7A, 7B, and 7C, each of the elastic portions 53 disposed at the ends of the dynamic vibration absorber 50 has grooves 56 and 57 in addition to the groove 55. The groove 56 is positioned closer to the weight 51 than the groove 55, and the groove 57 is positioned further away from the weight 51, that is, closer to the corresponding end than the groove 55.

The left and right grooves 55 are equally spaced from the center of the dynamic vibration absorber 50 in the left-right direction. In other words, the grooves 55 are formed such that the center of the gap therebetween coincides with the longitudinal center of the weight 51.

The center of the gap between the left and right grooves 56 coincides with the center of the gap between the left and right grooves 55, and the center of the gap between the left and right grooves 57 also coincides with the center of the gap between the left and right grooves 55.

Thus, the grooves 55 to 57 are provided at both ends of the dynamic vibration absorber 50 in the Z direction, which is the one direction, so that the grooves 55 to 57 are symmetrical in the left-right direction. Although three grooves 55 to 57 are provided at each end in the example illustrated in FIGS. 7A, 7B, and 7C, the number of grooves provided at each end may instead be two or four or more.

According to the attachment structure illustrated in FIGS. 7A, 7B, and 7C, the distance between the attachment members 70 is changeable.

In the case where the grooves 55 are used as illustrated in FIG. 7A, the distance between the attachment members 70 including the thicknesses of the attachment members 70 is L1. In the case where the grooves 56 are used as illustrated in FIG. 7B, the distance between the attachment members 70 including the thicknesses of the attachment members 70 is L2. In the case where the grooves 57 are used as illustrated in FIG. 7C, the distance between the attachment members 70 including the thicknesses of the attachment members 70 is L3.

The dynamic vibration absorber 50 having the grooves 55 to 57 formed therein may be applied to a case in which the distance between the attachment members 70 varies.

Figures 8A, 8B:
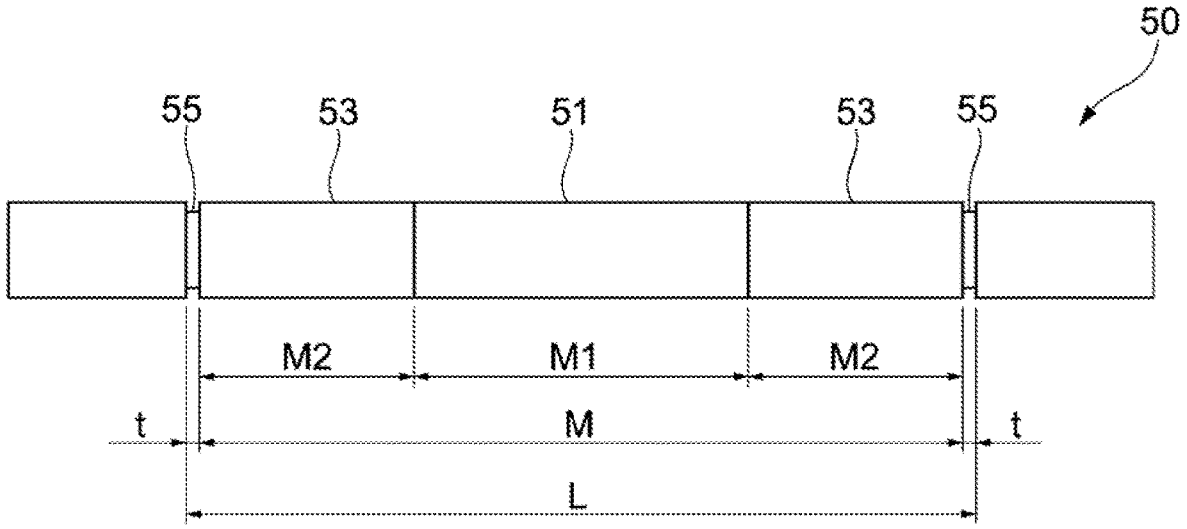

FIGS. 8A and 8B illustrate the relationship between the distance between the attachment members 70 and the natural frequency. FIG. 8A is a diagram illustrating the dimensions of the dynamic vibration absorber 50 used to calculate the natural frequency. FIG. 8B is a table showing the calculation results.

Referring to FIG. 8A, when M is the length of a portion of the dynamic vibration absorber 50 positioned between the two attachment members 70, and when the portion having the length M includes the weight 51 having a length M1 and parts of the elastic portions 53 having a length M2, M=M1+2×M2 is satisfied.

When t is the thickness of the attachment members 70, the overall length L is determined as L=2×t+M1+2×M2.

The items in the table illustrated in FIG. 8B are M1 (mm), M2 (mm), s (mm), t (mm), L (mm), and $f_{ave}$ (Hz) in that order from the left. Here, s is the amount by which the attachment members 70 that are fitted to the grooves 55 in the elastic portions 53 snap into the elastic portions 53 (amount of deformation), and $f_{ave}$ is the calculated natural frequency (average).

When the overall length L is 58 mm, the natural frequency $f_{ave}$ is 133.5 Hz. When the overall length L is 55 mm, the natural frequency $f_{ave}$ is 151.3 Hz. When the overall length L is 52 mm, the natural frequency $f_{ave}$ is 169 Hz.

The natural frequency $f_{ave}$ increases as the overall length L increases, and decreases the overall length L decreases.

The natural frequency $f_{ave}$ also varies in accordance with the thickness t of the attachment members 70. The natural frequency $f_{ave}$ increases as the thickness t increases, and decreases as the thickness t decreases.

As described above, the natural frequency $f_{ave}$ may be designed based on the dimensions of the dynamic vibration absorber 50 and the attachment members 70 including the distance between the grooves 55. Therefore, when the dynamic vibration absorber 50 has the grooves 56 and 57 in addition to the grooves 55, the dynamic vibration absorber 50 may be applied to plural LPHs 140 having different natural frequencies, and the versatility thereof may be increased.

In the case where the dynamic vibration absorber 50 has plural grooves 55, 56, and 57 at each end thereof, when the dynamic vibration absorber 50 is attached to the LPH 140, there is a risk that the attachment members 70 will be fitted to grooves other than the grooves intended to be used by mistake. Such a risk increases as the number of grooves increases.

To prevent such a mistake, the grooves 55, 56, and 57 may be arranged such that the distances between adjacent ones of the grooves 55, 56, and 57 differ from each other. This will be described in more detail.

Figure 9:
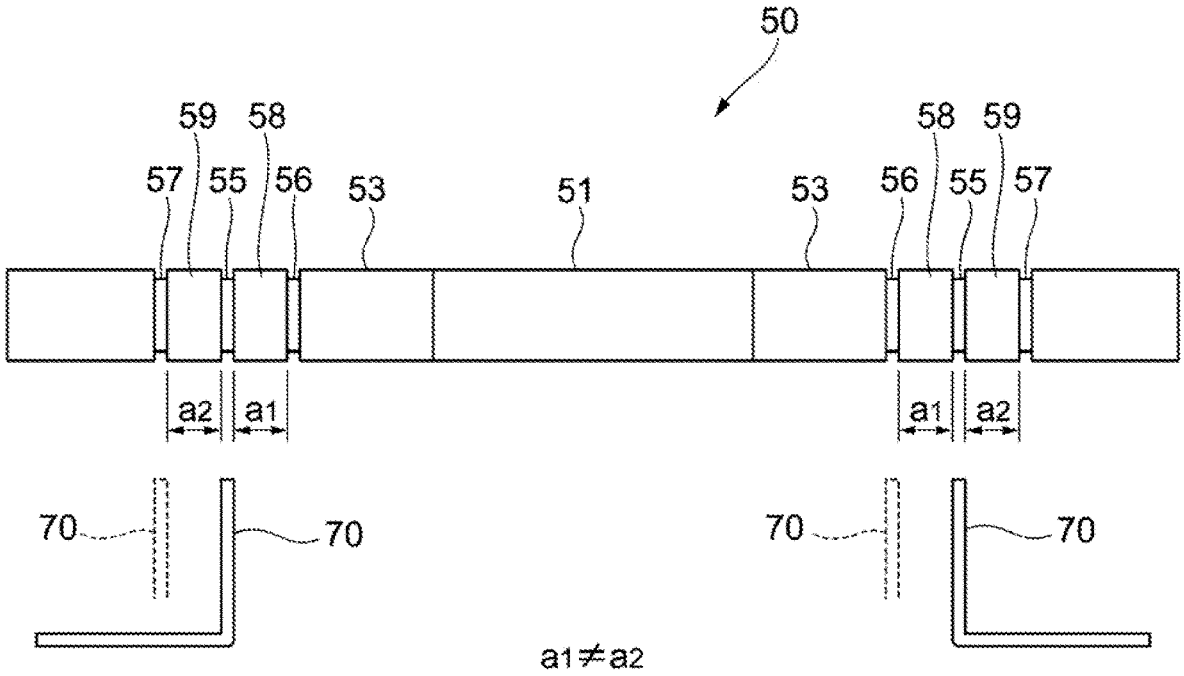
FIG. 9 illustrates the case in which the attachment structure illustrated in FIGS. 7A, 7B, and 7C is used.

FIG. 9 illustrates the case in which the attachment structure illustrated in FIGS. 7A, 7B, and 7C is used.

Referring to FIG. 9, each of the elastic portions 53 of the dynamic vibration absorber 50 is structured such that a length a1 of a portion 58 between the grooves 55 and 56 differs from a length a2 of a portion 59 between the grooves 55 and 57.

Assume that the dynamic vibration absorber 50 is to be attached to the attachment members 70 by using the grooves 55 at the left and right ends. Since the length a1 of each portion 58 and the length a2 of each portion 59 are not equal, the dynamic vibration absorber 50 is not easily attached to the attachment members 70 by using, for example, the groove 57 at the left end and the groove 56 at the right end (see dashed lines). Thus, a mistake in the assembly process may be prevented.

The present exemplary embodiment has various applications, such as direct drawing on, for example, a printed board.

For example, the LPH 140 according to the present exemplary embodiment may be applied to a flat-bed exposure device including a flat plate-shaped stage that holds a sheet-shaped recording material or a sheet-shaped photosensitive material (for example, a printed board) on a surface thereof by suction, or an outer drum exposure device including a drum around which a recording material or a photosensitive material (for example, a flexible printed board) is wound. The above-described LPH 140 (see, for example, FIGS. 2A and 2B) may be applied to an apparatus in which the LPH 140 is positioned in an axial direction of a rotating drum that holds a photosensitive material (sub-scanning direction) and is rotatable in a circumferential direction (main scanning direction) by rotating the rotating drum around the axis using a driving mechanism. Thus, the LPH 140 may be applied to an exposure device of a computer to plate (CTP) system in which a plate is directly exposed to light.

The above-described LPH 140 (see, for example, FIGS. 2A and 2B) may be suitably used in, for example, exposure of dry film resist (DFR) in a process of manufacturing a printed wiring board (PWB), formation of a color filter in a process of manufacturing a liquid crystal display (LCD), exposure of DFR in a process of manufacturing a TFT, or exposure of DFR in a process of manufacturing a plasma display panel (PDP).

According to the above-described LPH 140, both a photon mode photosensitive material on which information is directly recorded by exposure to light and a heat mode photosensitive material on which information is recorded by heat generated by exposure to light may be used. When a photon mode photosensitive material is used, a GaN-based semiconductor laser or a wavelength conversion solid-state laser, for example, is used as a laser device. When a heat mode photosensitive material is used, an AlGaAs-based semiconductor laser (infrared laser) or a solid-state laser is used as a laser device.

The LPH 140 according to the present exemplary embodiment may be applied to a light emitting device other than an exposure device. For example, the LPH 140 may be applied to a light source of a display device, such as an on-board projector, used in an environment where vibrations occur.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A light emitting device comprising:

a light emitting unit including a plurality of light emitting elements arranged in one direction and emitting light in a same direction;

a dynamic vibration absorber including a weight positioned at a center of the light emitting unit in the one direction and an elastic portion that supports the weight such that the weight is capable of vibrating; and an attaching member including a portion inserted in a groove formed along an outer perimeter of the elastic portion of the dynamic vibration absorber, the portion attaching the dynamic vibration absorber to the light emitting unit.

2. The light emitting device according to claim 1, wherein the groove in the elastic portion is one of a plurality of grooves formed at end portions of the elastic portion in the one direction.

3. The light emitting device according to claim 2, wherein the plurality of grooves formed at the end portions of the elastic portion in the one direction include at least three grooves, and distances between adjacent ones of the at least three grooves differ from each other.

4. The light emitting device according to claim 1, wherein the portion of the attaching member has an open shape with a cut that allows the elastic portion of the dynamic vibration absorber to pass therethrough.

5. The light emitting device according to claim 4, wherein the cut in the attaching member is formed to allow the elastic portion of the dynamic vibration absorber to pass therethrough when the elastic portion is deformed.

6. The light emitting device according to claim 4, further comprising another attaching member having a portion with an open shape with a cut that allows the elastic portion of the dynamic vibration absorber to pass therethrough.

7. The light emitting device according to claim 6, wherein the cut in the other attaching member is formed to allow the elastic portion of the dynamic vibration absorber to pass therethrough when the elastic portion is deformed.

8. The light emitting device according to claim 6, wherein the cut of the attachment member and the cut of the other attachment member open in a same direction.

9. The light emitting device according to claim 6, wherein the cut of the attachment member and the cut of the other attachment member open in different directions.

* * * * *